United States Patent [19]

Callaway

[11] Patent Number: 4,577,442

[45] Date of Patent: Mar. 25, 1986

[54] RIDGE ROW CLAMP

[76] Inventor: Ernest F. Callaway, 5413 Hedges, Raytown, Mo. 64133

[21] Appl. No.: 514,547

[22] Filed: Jul. 18, 1983

[51] Int. Cl.[4] ..... E04D 3/40

[52] U.S. Cl. ..... 52/57; 52/547; 52/278

[58] Field of Search ..... 52/43, 275–279, 52/288, 547, 549, 552, 57, 658

[56] References Cited

U.S. PATENT DOCUMENTS

| | | | |
|---|---|---|---|
| 1,581,136 | 4/1926 | Moeller | 52/277 |
| 3,905,165 | 9/1975 | Kneisel | 52/58 |
| 3,953,946 | 5/1976 | Peters et al. | 52/57 |
| 4,015,391 | 4/1977 | Epstein et al. | 52/57 |
| 4,187,650 | 2/1980 | Poplin | 52/57 |
| 4,322,924 | 4/1982 | Cooper | 52/57 |
| 4,445,302 | 5/1984 | Dean | 52/278 |

FOREIGN PATENT DOCUMENTS

| | | | |
|---|---|---|---|
| 2315610 | 10/1974 | Fed. Rep. of Germany | 52/57 |
| 31784 | 5/1961 | Finland | 52/57 |
| 1511216 | 1/1968 | France | 52/43 |
| 2431010 | 3/1980 | France | 52/57 |
| 44475 | 6/1908 | Switzerland | 52/547 |
| 679044 | 9/1952 | United Kingdom | 52/658 |

OTHER PUBLICATIONS

Brochure entitled The Ridge Company, by The Ridge Co.

Book entitled Roofs and Siding (Home Repair and Improvement) by the editors of Time–Life Books, pp. 86, 87, 88, 89 and 90.

*Primary Examiner*—John E. Murtagh

*Assistant Examiner*—Caroline Dennison

*Attorney, Agent, or Firm*—D. A. N. Chase; Michael Yakimo, Jr.

[57] ABSTRACT

A shingle mount for affixing first and second shingles along a roof ridge comprises a sheet member bendable about its longitudinal, medial axis to present first and second plates sloping therefrom. The mount is nailed atop the roof ridge so that the medial axis of the sheet defines the ridge line with the plates overlying the adjoining roof surfaces. At the end of each plate is a clamping flange which holds a ridge shingle atop each plate and in a proper position along the roof ridge upon insertion of the butt end of a shingle therein. The underlying plates direct moisture away from the overlying shingles and cooperate with the perforated clamping flanges to inhibit prolonged contact of deteriorating moisture with the ridge shingles so as to prolong shingle life.

7 Claims, 5 Drawing Figures

RIDGE ROW CLAMP

BACKGROUND OF THE INVENTION

This invention pertains to roofing shingles, and more particularly, to a shingle mount utilized in shingling the ridges of a house roof.

The conventional method of shingling a ridge line is to simply nail first and second shingles in an abutting relationship on the opposed roof surfaces sloping away from the ridge line. Subsequent pairs of abutting shingles, overlapping the antecedent pair, are likewise nailed along the ridge line until the ridge row of shingles is completed. Another method utilizes a plurality of one-piece ridge shingles which mirror the configuration of the ridge line. These one-piece shingles are nailed along the ridge line in an overlapping relationship therebetween to present the ridge row of shingles.

Wood shingles or shakes need proper drainage and ventilation to allow contacting moisture to evaporate. Although shakes are somewhat irregularly split, which presents a natural ventilation, this surface irregularity allows moisture, particularly melting snow, to filter to a position underneath the shingle.

This trapped, shingle-contacting moisture can hasten the deterioration of the overlying ridge shingles as well as the roof shingles inferiorly adjacent thereto. Such deleterious effects have been evidenced by the common need to replace the ridge shingles along the main and/or hip ridges of a roof prior to an entire reroofing being required.

In response thereto, I have invented a mounting bracket for clamping shingles along a ridge line which effectively inhibits prolonged contact of deteriorating moisture with the ridge shingles. My shingle mount comprises a metal sheet bendable along its longitudinal medial axis so as to present a constructive ridge line with first and second plates sloping therefrom. In use the bracket is nailed to the roof so that the constructive ridge line of the bracket overlies the roof's ridge line with the plates overlying the respectively adjoining surfaces of the roof. Extending from an end of each plate is a perforated clamping flange for gripping the butt end of a ridge shingle therein. First and second shingles are thereby clamped atop the respective plates and in a side-by-side, ridge-line relationship. A second mounting bracket, overlapping the antecedent ridge shingles, is likewise nailed to the roof for subsequent clamping of a pair of ridge row shingles therein. This process is repeated until the ridge line is entirely shingled.

I have found that the underlying plates are effective in directing moisture away from the overlying shingles and cooperate with the perforated clamps to allow the butt end of the shingle to "breathe" so that moisture may pass therethrough. Accordingly, the utilization of my mount enhances the affixation of ridge shingles to the roof and prolongs shingle life without interfering with the conventional roofing method.

It is therefore, a general object of this invention to provide a bracket utilized in mounting shingles along a ridge line of a roof.

Another object of this invention is to provide a bracket, as aforesaid, adaptable for use on a ridge line of a roof having sloping surfaces of various pitches.

Still another object of this invention is to provide a mounting bracket, as aforesaid, which effectively inhibits the prolonged contact of damaging moisture with the ridge row shingles.

A more particular object of this invention is to provide a mounting bracket, as aforesaid, having fastener means thereon for clamping a ridge shingle atop a moisture-impervious plate and in a proper position relative to the ridge line.

Another object of this invention is to provide a mounting bracket, as aforesaid, which effectively affixes shingles to a roof and does not interfere with the conventional method of shingling.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
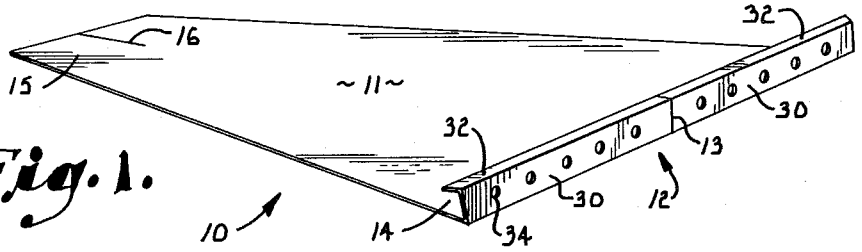
FIG. 1 is a perspective view illustrating the ridge row clamp.
Figure 2:
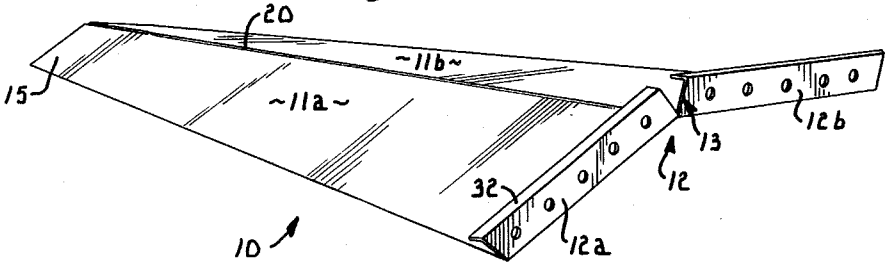
FIG. 2 is a perspective view of the apparatus in FIG. 1 subsequent to a bending of the metal sheet member along the medial axis thereof.
Figure 3:
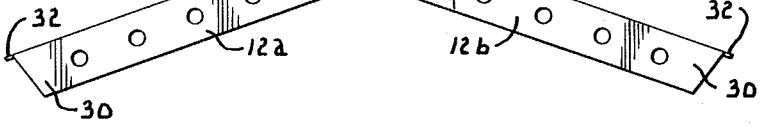
FIG. 3 is a end view of the mounting bracket and illustrates the perforated clamping flanges.

Referring more particularly to the drawings, FIG. 1 shows the ridge row clamp/mounting bracket 10 as comprising a quadrilaterally-configured sheet member 11 having an upstanding flange member 12 along one end 14 thereof. A score line 16 at the opposed end 15 of sheet 11 defines the medial longitudinal axis of the sheet 11.

The sheet 11 is preferably made of a light-weight metal generally impervious to moisture and bendable along the score line 16 and the extent of the imaginary longitudinal medial axis colinear therewith. Upon bending of the sheet 11, a longitudinally extending edge 20, forming a constructive ridge line, is presented having first and second plates 11*a* and 11*b* sloping therefrom. Concurrent with the bending of the sheet 11, the flange member 12 is likewise bendable and separable along a score line 13, normally aligned with the medial axis, to present first 12*a* and second 12*b* clamps.

Flange 12 and each resulting clamp element 12*a*, 12*b* comprise an upstanding perforated backwall 30 generally normal to the surface of the associated plate 12*a*, 12*b*. Normally projecting from atop the wall 30 is a lip 32 generally parallel to the surface of the inferiorly disposed plate 11*a* or 11*b*. The height of the upstanding wall 30 is dimensioned so that lip 32 clamps the butt end 55 of a ridge row shake 58, 60 onto the underlying plate 11*a*, 11*b*.

Figure 4:
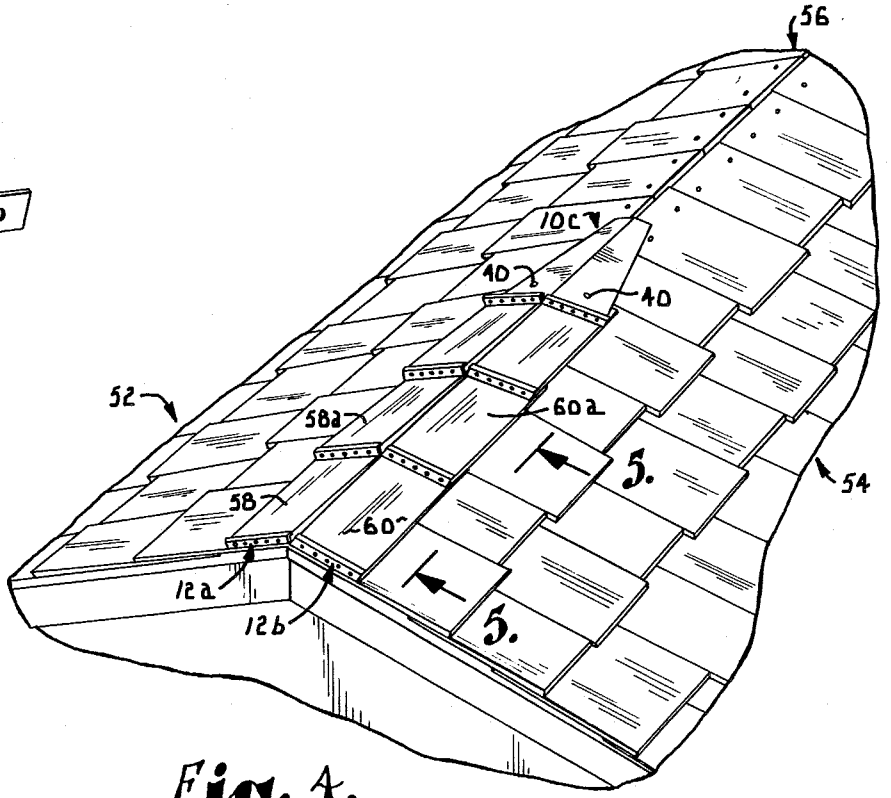
FIG. 4 is perspective view of a ridge line of a roof and illustrating a shingling of a portion of a ridge line utilizing the shown in FIGS. 1–3.

In use, as shown in FIG. 4, the bracket 10 is bent along the medial axis of sheet 11 as defined by score line 16 so that the slope of the plates 11*a*, 11*b*, relative to the resulting edge 20, corresponds to the slope of the roof surfaces 52 and 54 relative to the ridge line 56. The first bracket 10 is nailed to the roof so that the edge 20 of the bracket 10 constructively defines a segment of the ridge line 56 with the plates 11*a* and 11*b* sloping along the plane of the adjoining roof surfaces 52, 54.

Subsequent to affixation of the bracket 10 to the ridge line 56, first and second generally rectangular ridge shakes 58, 60 are positioned atop the plates so that the butt ends 55 thereof are respectively received between the lip 32 of each clamping flange 12*a* or 12*b* and underlying plate 11*a*, 11*b*. The opposed longitudinal edges of each rectangular shake 58, 60 lie along the common edge 20 and in an abutting relationship therebetween. Accordingly, the shakes 58 and 60 are positioned in a side-by-side, abutting relationship to present a shingled portion of the ridge line 56.

Figure 5:
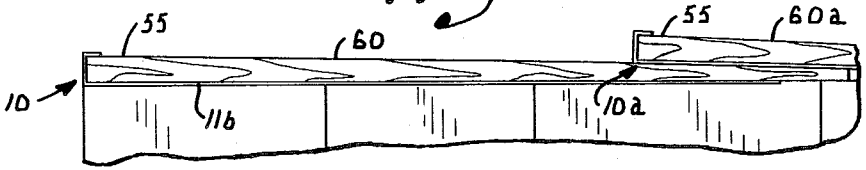
FIG. 5 is an elevation view, taken along line 5—5 in FIG. 4, and illustrating the overlapping relationship between successive mounting brackets and the shingles clamped therein.

Subsequently, a second mounting bracket 10*a* is placed in an overlapping relationship with the shakes 58, 60, as shown in FIG. 5, and nailed 40 to the roof in a manner as above-described. A second pair of shakes 58*a*, 60*a* are then received by the appropriate clamping flanges 12*a*, 12*b*, in a manner as above-described, to present a subsequently shingled portion of ridge line 56. This process is repeated with subsequent brackets 10*b*, 10*c* et seq. until the entire ridge row of shingles along the ridge line 56 is in place.

Each mounting bracket 10 provides a protective cover for the ridge line 56 which inhibits the seepage of moisture between the side-by-side shingles 58, 60 et seq. and onto the shingles of the adjoining roof surfaces 52, 54. Moreover moisture entering any resulting gap between the side-by-side shingles 58, 60 et seq. is channeled away from the ridge line 56 and the overlying ridge shingles 58, 60, by the moisture-impervious sloping plates 11*a*, 11*b*. It is also here noted that the plates 11*a*, 11*b* also preclude moisture from being trapped between the ridge shingles 58, 60 and the underlying shingles of the adjoining roof surfaces 52, 54. Furthermore the plurality of apertures 34, presenting the perforated wall 30 of each clamp 12*a* or 12*b*, allow the clamped shingles to "breathe" which diminishes moisture build-up underneath the shingles 58, 60 and the accompanying deleterious effects thereof. Accordingly, the cooperation of the sloping plates 11*a*, 11*b* with the perforated flanges 12*a*, 12*b* inhibits prolonged contact of the moisture with the shingles 58, 60 which enhances the shingle life.

Although my preferred embodiment illustrates the use of first and second shake shingles 58, 60 the above-mentioned one-piece ridge shingles may also be utilized with similar advantages and results. Thus it is to be understood that while certain forms of this invention have been illustrated and described, it is not limited thereto, except in so far as such limitations are included in the following claims.

Having thus described the invention, what is claimed as new and desired to be secured by a Letters Patent is:

1. For use in shingling first and second opposed surfaces forming a ridge of a roof, a shingle mount apparatus comprising the combination of:

first and second roofing shingles;

a sheet member bendable about an imaginary longitudinal axis to present an edge having first and second plates sloping therefrom;

fastener means on said sheet and movable therewith to present first and second fastener elements on said first and second plates attaching a repective shingle atop said respective plate, each fastener element comprising:

an upstanding support member generally normal to said sheet and lying generally perpendicular to said ridge upon affixation of said sheet to said ridge; and a lip extending from said upstanding support and above said plate and lying generally perpendicular to said ridge upon said affixation, each lip clamping a shingle to said associated plate upon insertion of an edge of said shingle therebetween; and means for affixing said sheet to said roof with said sheet edge defining the edge of said roof ridge and said first and second plates respectively overlying said opposed surfaces of said roof forming said ridge, whereupon said attachment of said shingle to said affixed plate by said fastener element presents a shingling of a segment of said surface underlying said respective plate and forming said roof ridge.

2. The apparatus as claimed in claim 1, wherein said upstanding wall is perforated to allow passage of moisture therethrough and away from said associated shingle.

3. The apparatus as claimed in claim 1, wherein said plates are made of a material generally impervious to moisture for direction of moisture along each sloping plate to points exterior thereof whereby to diminish contact of moisture on said plate with said overlying shingle.

4. The apparatus as claimed in claim 1, further comprising a score line on said sheet defining said longitudinal axis to assist said bending of said sheet therealong.

5. For use in shingling the opposed surfaces forming a ridge of a roof, a shingle mount apparatus comprising the combination of:

first and second roof shingles;

a plate bendable about an imaginary longitudinal axis to present an edge with first and second sections of said plate sloping therefrom;

means for affixing said plate to said roof with said plate edge overlying said roof ridge and said first and second plate sections respectively overlying said opposed surfaces of said roof forming said ridge; and a fastener element on each plate attaching said first and second shingles to said respective plates each fastener element comprising:

a clamping surface; and means for positioning said clamping surface above said plate to present a gap between said surface and said plate for insertion of an edge of a shingle therein, said clamping surface bearing against said shingle edge in a manner to position said shingle atop said plate and at least one edge of said shingle generally perpendicular to said ridge, whereby to shingle a portion of said underlying opposed surface of said ridge.

6. The apparatus as claimed in claim 5, wherein said positioning means comprises an upstanding wall generally normal to said plate for supporting said clamping surface in said position displaced from said plate sections.

7. For use in shingling at least one of the opposed surfaces forming a ridge of a roof, a shingle mount apparatus comprising the combination of:

a roofing shingle;

a plate having a generally planar surface;

fastener means on said plate attaching said shingle thereto said fastener means comprising:

an upstanding support element generally normal to said plate and perpendicular to said ridge upon affixation of said plate to said ridge; and a lip extending from said upstanding support and above said plate and lying generally perpendicular to said ridge upon said affixation, said lip clamping a shingle to said plate upon insertion of an edge of said shingle therebetween; and means for affixing said plate to said opposed surface of said roof whereupon said attachment of said shingle to said plate shingles a portion of said at least one opposed surface of said roof ridge.

* * * * *